United States Patent [19]

Weirich et al.

[11] Patent Number: 4,537,221

[45] Date of Patent: Aug. 27, 1985

[54] HYDRAULIC CONTROL DEVICES FOR USE WITH MINING APPARATUS

[75] Inventors: Walter Weirich, Dortmund; Michael Dettmers, Kamen, both of Fed. Rep. of Germany

[73] Assignee: Gewerkschaft Eisenhutte Westfalia, Lunen, Fed. Rep. of Germany

[21] Appl. No.: 603,456

[22] Filed: Apr. 24, 1984

[30] Foreign Application Priority Data

Apr. 27, 1983 [DE] Fed. Rep. of Germany ..... 3315313

[51] Int. Cl.[3] ..... F16K 31/122; F16K 31/524

[52] U.S. Cl. ..... 137/637.2; 74/54; 251/262; 92/134

[58] Field of Search ..... 137/637, 637.1, 637.2; 74/54; 251/251, 263, 262

[56] References Cited

U.S. PATENT DOCUMENTS 2,099,368 11/1937 Levy ..... 92/134

4,031,966 6/1977 Farrell ..... 92/134

4,310,027 1/1982 Weirich ..... 251/263

FOREIGN PATENT DOCUMENTS 526213 6/1931 Fed. Rep. of Germany ..... 92/134

*Primary Examiner*—George L. Walton

*Attorney, Agent, or Firm*—Maurice E. Gauthier

[57] ABSTRACT

A compact hydraulic control device for use with mining apparatus is composed of a housing block containing tappet-operated valves. A multi-part cam shaft serves selectively to operate the valves by displacing the tappets by manual control effected by external levers. To automatically restore the cam shaft back into a neutral position as a "dead-man's handle" restoring system use is made of a pair of piston and cylinder assemblies mounted as detachable cartridges in parallel locations within bores in the housing block and having push rods which act on a cam of the cam shaft under the action of hydraulic or pneumatic pressure medium.

9 Claims, 3 Drawing Figures

HYDRAULIC CONTROL DEVICES FOR USE WITH MINING APPARATUS

FIELD OF THE INVENTION

The present invention relates to hydraulic control devices particularly, but not solely, for use with mining apparatus, such as roof supports.

BACKGROUND TO THE INVENTION

In mineral mining, it is known to provide a number of control valves in a common block and to actuate the valves selectively with the aid of tappets by partially rotating a part of a composite cam shaft with the aid of a manual lever accessible from outside the block. On release of the lever, the cam shaft part is automatically restored to a neutral non-operative position by a "deadman's handle" type of restoration system.

U.S. Pat. No. 4,310,027 issued Jan. 12, 1982 and assigned to the same assignee as this application, describes a known device and this patent is herein incorporated by a reference. U.S. patent application Ser. No. 485,243 filed Apr. 15, 1983 and also assigned to the same assignee as the present application also describes another form of device related to the present invention.

A general object of the present invention is to provide an improved form of hydraulic control device.

SUMMARY OF THE INVENTION

In contrast to the device described in the aforementioned U.S. Pat. No. 4,310,027, the restoration system of the present invention comprises a pair of piston and cylinder units which are arranged in parallel bores within the main valve block and which have push members engaging on a cam. This enables the dimensions of the device to be minimal since long springs are not needed and the units can be almost entirely accommodated in the main block. The restoration characteristics are also improved and manual operation of the levers is not hindered by spring force.

According to the invention a hydraulic control device comprises a valve block or housing, a plurality of individual control valves operated by tappets, manually-operable rotatable cam shaft means for displacing the tappets to operate the valves and an automatic restoration system for acting on the cam shaft means to restore at least part of the cam shaft means back into a neutral position when manually released, wherein said restoration system comprises piston and cylinder assemblies detachably mounted as cartridges within bores within the housing, and said assemblies serving to act on a cam of the cam shaft means to bias said part into its neutral position and passages within the housing, the cylinders of the assemblies to permit the pistons thereof to be exposed to pressure-medium to create the restoration force.

The cam shaft means may itself comprise a rotatable central spindle surrounded by independently rotatable sleeves. The spindle and each sleeve have a manually-operable lever accessible exteriorly of the housing. The spindle and each sleeve are also provided with a cam acted on by a pair of regulator pistons of the piston and cylinder assemblies.

The passages may include at least one bore which connects an internal working chamber of the cylinder of each piston and cylinder assembly with an external chamber formed between the exterior of the cylinder and the interior of a bore receiving said assembly. Conveniently this bore is in hydraulic communication, within the valve block, with the hydraulic working fluid or medium to be controlled by the valves. The external chamber is preferably formed by a peripheral constriction or recess in the cylinder exterior into which opens at least one radial bore through which the pressure loading of the regulator piston takes place.

Thus, with the invention, the return of the cam shaft means into its neutral position on release of one or more levers is achieved with the aid of a small, springless, regulator piston of one of the aforementioned assemblies which is constantly subject to the loading of pressure medium (hydraulic or pneumatic). The piston has a small cross-section so that on partial rotation of the cam shaft means by means of the hand lever the piston can act against the restoration pressure in the cylinder chamber without causing an excessively great resistance to the movement of the cam shaft in doing so. The cylinder of the assembly is introduced in the style of a cartridge into the reception bore of the valve block and removably held therein, for example, by means of a screw connection.

All functional parts of the restoration system can lie protected in the interior of the valve block. The cylinder also has relatively small dimensions and at most protrudes with its end opposite to the piston rod, slightly out of the bore of the valve block. By introducing the cylinder into the bore of the valve block a hydraulic connection of the cylinder working chamber with a passage of the valve block for conducting the hydraulic pressure medium is automatically ensured. It is advisable to provide in the cylinder at least one further compensation bore leading from the cylinder exterior to the annular chamber situated on the piston rod side to the regulator piston. Pressure fluid or air can be sucked in and discharged through this further bore as the piston moves in the cylinder.

The cylinder is expediently closed at its end opposite to the piston rod by a disengageable closure piece, preferably a screw threaded stopper or the like which is accessible exteriorly of the valve block. The piston rod protrudes from the opposite end of the cylinder via a seal. The piston rod can itself engage and cooperate with the restoration cam but a preferred arrangement is to use a separates push rod, expediently disengageably mounted on the free end of the piston rod to engage the cam. The disengageabe connection can be achieved with a push-in or snap-fit connection.

The invention may be understood more readily, and various other aspects and features of the invention may become apparent, from consideration of the following description.

BRIEF DESCRIPTION OF DRAWINGS

An embodiment of the invention will now be described, by way of example only, reference to the accompanying drawings, wherein.

DESCRIPTION OF PREFERRED EMBODIMENT

Figure 1:
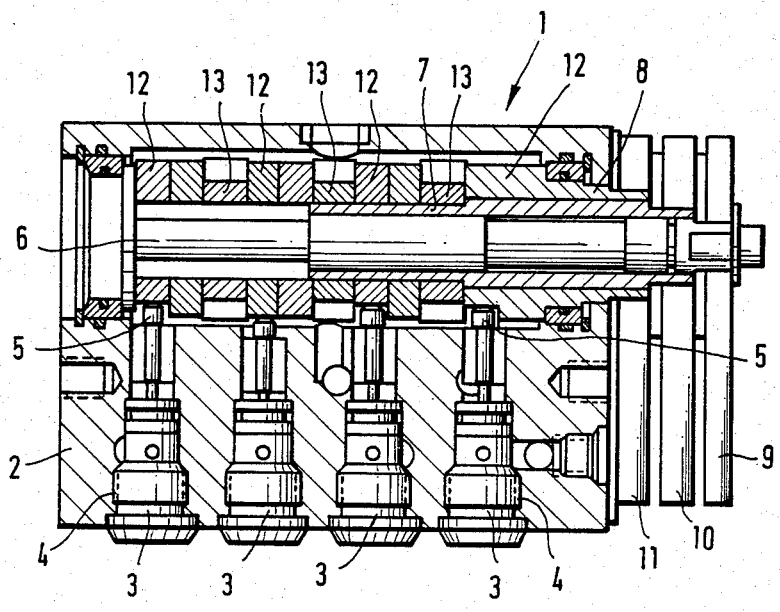
FIG. 1 is a sectional side view of a hydraulic control device constructed in accordance with the invention.
Figure 2:
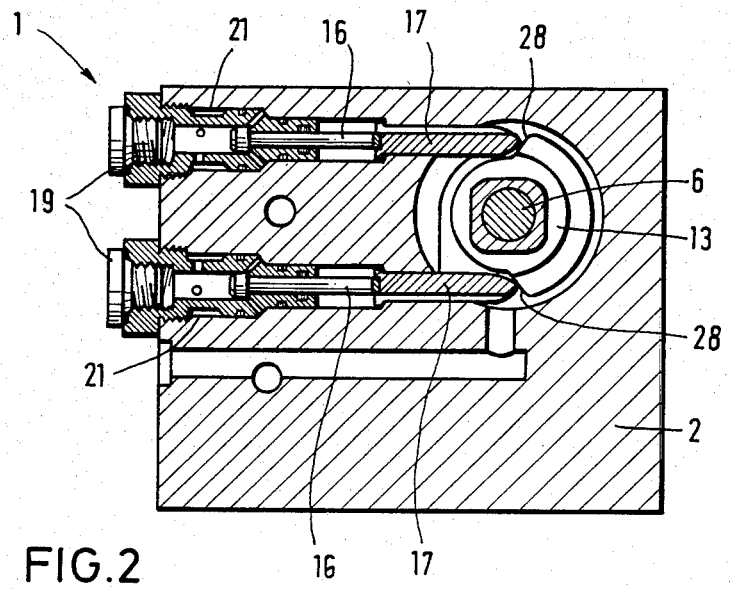
FIG. 2 is a sectional end view of the device shown in FIG. 1.
Figure 3:
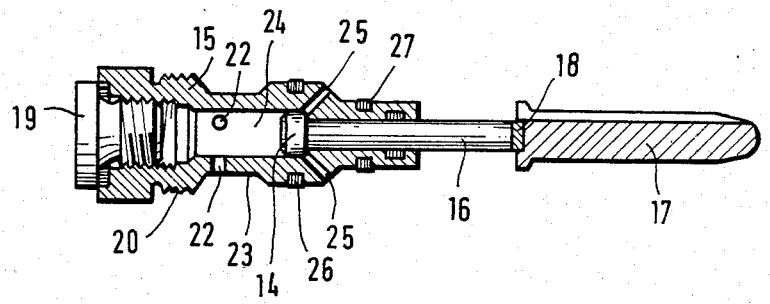
FIG. 3 is a part sectional side view of an assembly used in the device shown in FIGS. 1 and 2, the view being taken on a somewhat larger scale to that adopted in FIGS. 1 and 2.

The hydraulic control device shown in the accompanying drawings and generally designated 1 is similar in many respects to that described in U.S. Pat. No. 4,310,027. As shown in the drawings, the device has a main block or housing 2 in which are disposed a plurality of borings and individual control valves 3 located in adaptive stepped bores 4. The valves 3 are constructed as cartridges which form easily replaceable and interchangeable units screwed or otherwise fitted into the block 2. The valves 3 are actuated by means of tappets 5 conveniently forming parts of the cartridges and which are displaced by multi-part cam shaft means rotatably mounted in the housing or block 2. The cam shaft means includes a central spindle 6 surrounded by coaxial sleeves 7, 8. The spindle 6 and the sleeves 7, 8 project outwardly from one end of the block 2 and manually-operable levers 9, 10 and 11 are mounted to the components 6, 7 and 8, respectively, in order to permit partial rotation of the spindle 6 and/or the sleeves 7, 8 about their common rotational axis. The sleeves 7, 8 and the spindle 6 are provided with cams 12 each of which serves to actuate the individual tappets 5 associated with one of the valves 3 or a group of valves 3. In order to restore automatically the spindle 6 and the sleeves 7, 8 into a neutral position, a biasing, or "deadman's handle" restoring system is provided. As represented in FIGS. 2 and 3 this system is composed of piston and cylinder assemblies mounted in the block 2, again as easily replaceable cartridges fitted into bores thereof. The spindle 6 and the sleeves 7, 8 are provided with additional cams 13 of which is subjected to the action of a pair of the piston and cylinder assemblies arranged parallel to one another. FIG. 2 depicts the assemblies pertaining to the cam 13 of the spindle 6 and one of the assemblies is shown on a somewhat larger scale in FIG. 3.

Each piston and cylinder assembly has a piston 14 slidably guided within a cylinder 15 and the piston rod 16 which leads from one end of the cylinder 15 through a seal as shown. The piston rod 16 carries a push rod 17 conveniently connected thereto as a push-on or snap-fit connection 18. At the end of the cylinder 15 remote from the piston rod 16 there is a closure in the form of a threaded end piece 19 which is engaged within a threaded bore within an end region of the cylinder 15. This end region also has an external screw thread 20 which enables the entire assembly to the detachably engaged with a similar screw-thread within a reception bore 21 in the block 2. As shown in FIG. 2, when a pair of piston and cylinder assemblies are engaged within the bores 21 a shoulder of the end region of each assembly engages on a face of the block 2 and the closures 19 are accessible.

The cylinder 15 of each assembly has radial bores 22 which lead from an internal working chamber 24 of the cylinder 15 to the exterior via a recessed intermediate portion 23 of the cylinder 15. These bores 22 thereby establish connection between the internal chamber 24 and a further external chamber formed between the recessed part 23 and the surrounding wall of the bore 21 in the block 2. These external chambers can be maintained under a constant pressure by appropriate connection with a source of pressure medium and in this way the piston 14 are all subjected to this pressure via the internal chambers 24. Conveniently, the external chamber can lead to a hydraulic pressure line within the block which forms an input to the valves so that the chambers 24 contain hydraulic fluid when the piston rods 16 are extended as shown in FIG. 2. Further bores 25 lead from the exterior of each cylinder 15 to an annular chamber in the cylinder 15 adjacent the rod 16. Sealing rings or gaskets are provided on the exterior of the cylinder 15 between the outlets of the bores 25, 22 and also between the inner end of the cylinder 15 and the outlets of the bores 25.

FIG. 2 shows one of the cams 13 mounted on the spindle 6, in a position with the spindle 6 in its neutral position. On diametrically opposite sides, the cam 13 has faces 28 which engage against the push rods 17 of the associated piston and cylinder assemblies. As the lever 9 is operated to partially rotate the spindle 6 in either direction the cam 13 forces one or other of the rods 17 to retract the piston rod 16 within the associated cylinder 15. As the occurs, the piston 14 expels pressure medium from the bores 22 but when the lever 9 is released the pressure medium will force the piston 14 back again to extend the piston rod 16 to cause the rod 17 to bring the cam 13 and hence the spindle 6 back into the neutral position. The radial bores 25 open into a region of the bore 21 which is either connected direct to atmosphere where the pressure medium is pneumatic or to a hydraulic return line where the pressure medium is hydraulic so that when the lever 9 is released and the piston rod 16 extends there is no reaction on the opposite side of the piston 14. The bores 25 could however be in communication with the hydraulic pressure line so that the piston 14 is exposed to the same fluid pressure on both sides but the greater area in the chamber 24 ensures the piston rod 16 is normally fully extended as shown.

The components 6, 7 and 8 are all provided with their own restoring system so that each of these components will be brought back into the neutral position automatically by the appropriate section of the cam shaft means.

We claim:

1. In a hydraulic control device comprising a housing, a plurality of individual control valves operated by tappets, manually-operable rotatable cam shaft means for displacing the tappets to operate the valves, and an automatic restoration system for acting on the cam shaft means to restore at least part of the cam shaft means back into a neutral position when manually released; the improvement comprising said restoration system includes at least a pair of hydralic piston and cylinder assemblies detachably mounted as cartridges within reception bores within the housing, one of said assemblies serving to act on a cam of the cam shaft means depending on the rotation of said cam to bias said part into its neutral position while a pressure medium is expelled from the other of said assemblies, and passage means within the housing communicating via said reception bores with the cylinders of the assemblies to permit the pistons thereof to be exposed to pressure-medium to create the restoration force.

2. A device according to claim 1, wherein said passage means includes at least one bore in the cylinder of each piston and cylinder assembly which connects an internal chamber of the cylinder on one side of the piston contained therein with an external chamber, said external chamber being connectible to a source of pressure medium and being formed between the exterior of the cylinder and the interior of the respective reception bore.

3. A device according to claim 2, wherein each assembly has at least one further bore in the cylinder which connects the exterior of the cylinder with a further annular working chamber surrounding a piston rod extending from the opposite side of said piston.

4. A device according to claim 3, wherein the cylinder of each assembly has seals on its exterior which sealably engage with the wall of the reception bore of the housing in which the assembly is received.

5. A device according to claim 1, wherein the cylinder of each assembly is closed at one end by means of a removable closure piece which is located exteriorly of the housing.

6. A device according to claim 1, wherein each assembly has a piston rod which carries a detachably mounted push rod which engages on said cam.

7. A device according to claim 1, wherein the cam shaft means comprises a rotatable central spindle surrounded by independently rotatable sleeves, the spindle and each sleeve having a manually-operable lever accessible exteriorly of the housing and wherein the spindle and each sleeve are provided with a cam acted on by a pair of said piston and cylinder assemblies.

8. A device according to claim 1, wherein the cylinder of each assembly has an external screw thread which engages with an internal screw thread in the reception bore of the housing receiving said assembly.

9. A device according to claim 1, wherein the cam shaft means is composed of relatively-rotatable parts each being independently manually-controlled with its own hand lever and having a plurality of cams for actuating several tappet-operated valves and wherein each part has its own automatic restoration system comprising said piston and cylinder assemblies.

* * * * *